US006765489B1

(12) United States Patent
Ketelhohn

(10) Patent No.: US 6,765,489 B1
(45) Date of Patent: Jul. 20, 2004

(54) ACCELEROMETER-BASED INFANT MOVEMENT MONITORING AND ALARM DEVICE

(75) Inventor: Charles H. Ketelhohn, Cedarburg, WI (US)

(73) Assignee: Milwaukee Electronics Corporation, Milwaukee, WI (US)

( * ) Notice: Subject to any disclaimer, the term of this patent is extended or adjusted under 35 U.S.C. 154(b) by 0 days.

(21) Appl. No.: 10/217,323

(22) Filed: Aug. 12, 2002

(51) Int. Cl.[7] ..... G08B 23/00
(52) U.S. Cl. ..... 340/573.1; 573/575
(58) Field of Search ..... 340/573.1, 573.3, 340/573.7, 573.6, 575, 568.1, 686.6, 328, 540, 566; 600/300, 595

(56) References Cited

U.S. PATENT DOCUMENTS

| | | | | | |
|---|---|---|---|---|---|
| 4,617,525 | A | | 10/1986 | Lloyd | 340/573.1 |
| 4,730,625 | A | | 3/1988 | Fraser et al. | 340/573.7 |
| 4,757,825 | A | | 7/1988 | Diamond | 340/575 |
| 4,829,285 | A | | 5/1989 | Brand et al. | 340/573.1 |
| 4,869,509 | A | | 9/1989 | Lee | 473/209 |
| 4,972,177 | A | | 11/1990 | Nolan | 340/573.7 |
| 5,008,654 | A | | 4/1991 | Callaway | 340/573.1 |
| 5,038,137 | A | | 8/1991 | Lloyd | 340/573.7 |
| 5,291,181 | A | | 3/1994 | DePonte | 340/573.6 |
| 5,317,305 | A | | 5/1994 | Campman | 340/573.1 |
| 5,369,623 | A | * | 11/1994 | Zerangue | 340/573.6 |
| 5,515,865 | A | | 5/1996 | Scanlon | 600/534 |
| 5,523,742 | A | | 6/1996 | Simkins et al. | 340/573.7 |
| 5,774,055 | A | | 6/1998 | Pomerantz | 340/573.7 |
| 5,796,340 | A | | 8/1998 | Miller | 340/573.7 |
| 5,914,660 | A | | 6/1999 | Mesibov et al. | 340/573.7 |
| 5,949,337 | A | * | 9/1999 | Campman | 340/573.1 |
| 6,011,477 | A | | 1/2000 | Teodorescu et al. | 340/573.1 |
| 6,057,767 | A | | 5/2000 | Barnoach | 340/575 |
| 6,064,910 | A | | 5/2000 | Andersson et al. | 607/20 |
| 6,160,478 | A | * | 12/2000 | Jacobsen et al. | 340/573.1 |
| 6,443,913 | B1 | * | 9/2002 | Kania | 600/595 |
| 6,582,380 | B2 | * | 6/2003 | Kazlausky et al. | 600/595 |

OTHER PUBLICATIONS

Analog Devices, "High Accuracy ± 1g to ± 5 g Single Axis iMEMSS® Accelerometer with Analog Input," 1999.

* cited by examiner

*Primary Examiner*—Van Trieu
(74) *Attorney, Agent, or Firm*—Boyle, Fredrickson, Newholm Stein & Gratz, S.C.

(57) ABSTRACT

A device for use with an infant that provides audible or visual signals based on a sensed lack of motion from an infant to stimulate motion by the infant. The sounds or light generated by the device are designed to encourage movement in an infant that is not moving, in order to reinitiate spontaneous movement by the infant and to alert a caregiver as to lack of movement by the infant. The device can also be configured to provide different audible sounds for different movements that are sensed by the device. The motion is sensed by an accelerometer disposed within the device that is formed of a monolithic integrated circuit chip. The accelerometer is connected to a controller that analyzes the accelerometer output signals and controls the sound or lights of the device in response to the accelerometer signals.

29 Claims, 2 Drawing Sheets

ACCELEROMETER-BASED INFANT MOVEMENT MONITORING AND ALARM DEVICE

FIELD OF THE INVENTION

The present invention relates to motion sensing devices and more specifically to a device which continuously measures the movement of an infant to determine whether the infant has stopped moving in order to stimulate the infant to resume motion if, in fact, the infant has stopped moving.

BACKGROUND OF THE INVENTION

Many parents lose sleep for the first several months of an infant's life. The loss of sleep may be caused by the need to care for the infant's needs, worry about the infant's health or safety, or any of a number of other reasons. Many parents place the infant in a bassinet or crib in their own room so that they are better able to respond to any need the infant may have. It is not uncommon for a parent to wake up in the night and place a hand on their sleeping infant's chest or abdomen to make sure the infant is moving. When motion is sensed or detected, the parent is reassured that the infant is sleeping peacefully. The parent may then resume his or her own peaceful sleep.

In the prior art, many different types of motion sensing devices have been developed for this purpose. One such device is disclosed in Teodorescu et al. U.S. Pat. No. 6,011,477 which discloses a movement monitoring system. The system includes a pair of sensors operably connected to a controller. The sensors are positioned within a mattress that is placed in contact with the infant and determine the amount of movement of the infant over a specified period of time. Signals illustrating the movement of the infant, or lack thereof, are periodically sent from the sensors to the controller for analysis. If the controller determines that the signals from the sensors illustrate that the infant is not moving, the controller then initiates an alarm depending upon the particular condition sensed by the sensors.

Another motion or position sensing device is disclosed in Mesibov et al. U.S. Pat. No. 5,914,660. In this device, a position sensing apparatus is attached to the infant that is to be monitored. The position sensing device then emits a signal which is received by a transceiver to monitor the condition of the infant. The transceiver then transmits the signal to a controller for analysis. If the controller receives a signal which indicates that the infant is no longer moving, the controller can emit a local or a general alarm signal to startle and awake the infant or notify another individual, such as a parent or babysitter in a separate location.

Still another motion sensing device is disclosed in Miller U.S. Pat. No. 5,796,340. In this device, a sensor disposed in a mattress monitors the motion of an individual sleeping on the mattress. The sensor is normally a pressure transducer, such as an electric condenser microphone, which receives and transmits signals indicating the movement of the individual on the mattress. If no signals are transmitted by the sensor during a predetermined period of time, the device then activates an alarm to indicate the non-movement condition to another individual or to stimulate motion by the individual sleeping on the mattress.

One final device used to sense motion or the lack thereof is disclosed in Scanlon U.S. Pat. No. 5,515,865. In this device, a fluid-filled sensor pad is positioned beneath an infant to measure pressure variations created by movement by the infant on the pad. The pressure variations are transmitted as signals to a monitor which determines whether the signals indicate motion or noise created by the infant that exceeds a specified threshold value. If the signals do not exceed the threshold value, the device will attempt to awaken or induce motion by the infant using vibrations, sound and/or lights. If signals exceeding the threshold are still not received, the device will initiate an alarm to notify an individual in a separate location from the infant of the lack of motion condition.

While each of the above-mentioned devices is useful in monitoring the movement of an infant, each of these devices includes a number of separate parts to the device which must be properly connected and/or positioned with respect to one another to ensure the proper operation of the device. The connection and placement of the separate parts of each of these devices greatly increases the complexity and the cost of the devices, making devices of this type prohibitively expensive for many individuals. Furthermore, with the multiple connections needed between the respective parts of each device, the possibility for damaging and/or misconnecting the parts to one another increases.

Therefore, it is desirable to develop a simple, low cost device for monitoring lack of movement of an infant which can be easily utilized by any number of individuals without the need for connecting a number of parts to the device or properly positioning the parts of the device about or to the infant.

SUMMARY OF THE INVENTION

It is an object of the present invention to provide a one piece infant movement monitoring and alarm device capable of sensing the lack of movement of an infant and providing an alarm in response to that sensed condition.

It is another object of the invention to provide a device that can be easily attached to the clothing of the infant in order to accurately sense a lack of motion condition.

It is still another object of the invention to provide an infant movement monitoring and alarm device that is easily operable and does not require multiple electrical connections to be made between separate parts of the device.

It is still a further object of the invention to provide a device that has a simple construction enabling the device to be manufactured and sold at a low cost.

The present invention is a movement monitoring and alarm device that can be used to detect the lack of motion of an infant. The confidence a parent gains in the detection of a lack of motion will allow the parent to sleep more soundly. The parent may no longer feel it is necessary to verify that an infant is moving by placing a hand on the chest of the infant.

The device has a unitary housing which encloses all of the sensing and actuating parts of the device. The housing also includes an external securing means attached to the exterior of the housing that is utilized to secure the device to the infant, such as by attaching the device to the clothing of the infant.

Within the interior of the housing, the device includes an accelerometer capable of sensing the movement of the infant to which the device is attached. The accelerometer is formed as a monolithic integrated circuit chip that incorporates a mechanical sensor and electronic signal conditioning circuitry on the chip. The chip is connected to an analyzer or controller which receives the output signal from the accelerometer and determines whether a lack of motion condition exists based on the output signal from the accelerometer. If the output signal is representative of a lack of motion condition for an extended period of time, the controller will initiate an alarm condition and activate an audible signal generator, such as a buzzer, to which the controller is also connected.

By activating the buzzer when a lack of motion condition is sensed by the accelerometer, the device will attempt to startle the infant into motion. However, if the alarm condition persists due to a continued lack of motion of the infant, the noise generated by the buzzer will cause a caregiver to check on the infant and determine the cause of the lack of motion. Once the device detects motion by the infant, the device will deactivate the buzzer and the alarm condition.

Various alternative embodiments and modifications to the invention will be made apparent to one of ordinary skill in the art by the following detailed description taken together with the drawings.

BRIEF DESCRIPTION OF THE DRAWINGS

The following drawings illustrate the best mode currently contemplated of practicing the present invention.

DETAILED DESCRIPTION OF THE INVENTION

Figure 1:
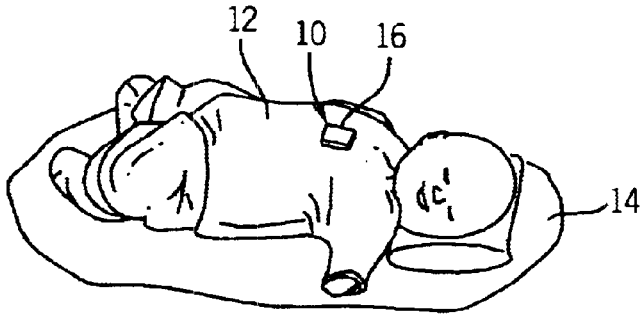
FIG. 1 is an isometric view illustrating the accelerometer-based infant movement monitoring and alarm device of the present invention attached to an infant.

With respect now to the drawing figures in which like reference numerals designate like parts throughout the disclosure, an accelerometer-based, infant movement monitoring and alarm device is indicated generally at 10 in FIG. 1. The device 10 is positioned on an infant 12 which is resting on a support surface 14, such as a mattress in a crib.

The device 10 includes a housing 16 formed of a generally rigid material, such as a hard plastic. The housing 16 is generally rectangular in shape, but may also have any shape desired so long as the housing provides a stable base for the device 10 to rest on and includes enough interior volume to enclose and retain the other components of the device 10. The device 10 also includes a securing means (not shown) attached to the housing 16 in order to retain the device 10 in position on the infant 12. The securing means can be any suitable means, such as a means that is securable around the body of the infant 12, e.g., a strap including a releasable hook and loop closure. Alternatively, the securing means can be attachable directly to the infant's clothing, such as by a spring-biased clip or a reusable adhesive. The device 10 can also be retained directly on the skin of the infant 12 by other suitable securing means, such as a suction cup or high friction material that contacts the skin.

Figure 2:
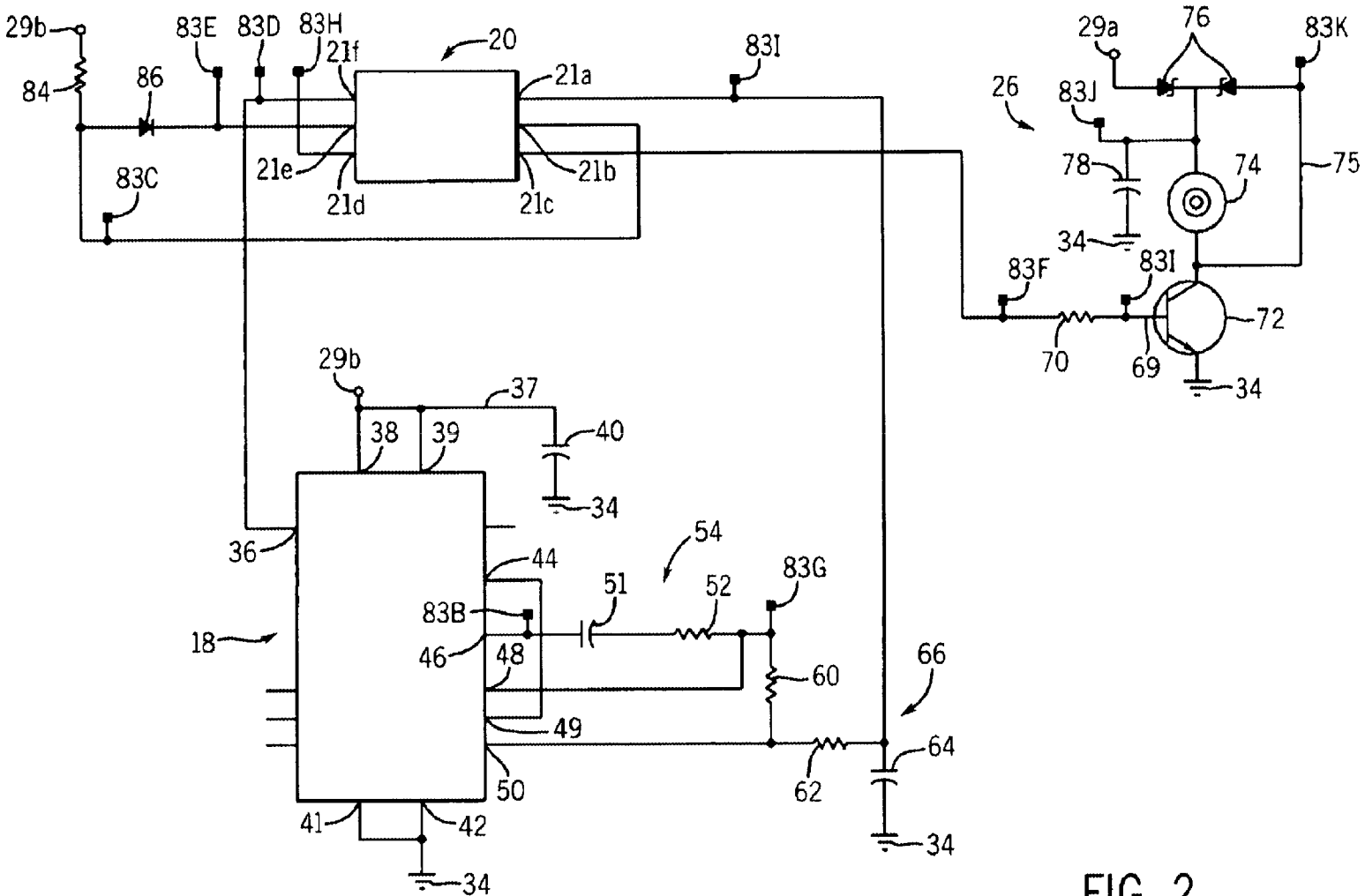
FIG. 2 is a schematic electric circuit diagram of the device of FIG. 1.

Referring now to FIG. 2, the internal components of the device 10 disposed within the housing 16 include an accelerometer 18, a controller 20, a power source 22 (shown in FIG. 3) and an alarm mechanism 24.

Figure 3:
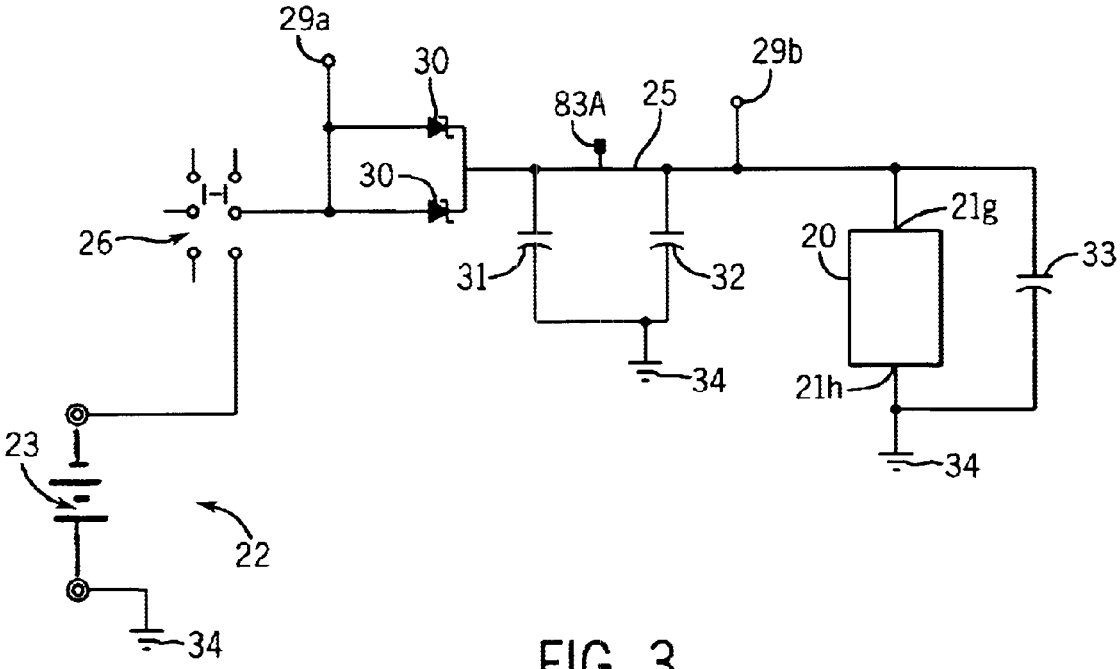
FIG. 3 is a schematic electric circuit diagram of a power supply connected to the device of FIG. 2.

As best shown in FIG. 3, the power source 22 comprises a number of batteries 23 positioned in series with respect to one another. Preferably, the batteries 23 each provide 1.4 volts for a total of 4.2 volts of power supplied to the accelerometer 18, controller 20 and alarm 24. However, depending on the voltage required to operate the particular accelerometer 18, controller 20 and alarm mechanism 24 used in the device 10, e.g., which can be in the range of 2.7 to 5.0 volts for the preferred controller 20, any combination of batteries having the requisite output voltage can be used to achieve the required power to operate the device 10.

The power source 22 is selectively and operably connected to the controller 20 by a power circuit 25 including a switch 26. The switch 26 can be any type of conventional circuit closing mechanism, such as a single pole, single throw switch, however the preferred switch 26 is a double-pole, double-throw switch. The switch 26 electrically connects the controller 20 with the batteries 23 in order to supply the operative power to the controller 20 as well as to the remaining parts of the device 10. When the switch 26 is closed, power from the batteries 23 flows through the switch 26 and through a pair of diodes 30 positioned in the circuit 25 between the switch 26 and the controller 20. The diodes 30 ensure that the power flowing along the circuit from the batteries 23 does not flow in a reverse direction along the circuit 25 back toward the batteries 23 in case the batteries 23 are inserted into the power source 22 incorrectly. The power also flows through a first position voltage connection 29*a* and is used to operate the alarm mechanism 24. After passing the diodes 30, the power from the batteries 23 is buffered by a pair of capacitors 31 and 32 connected to a ground 34 and is directed to an input pin 21*g* on the controller 20. Between the controller 20 and the diodes 30, the circuit 25 also includes a second positive voltage connection 29*b* connected to the accelerometer 18 and the test circuit for the controller 20 in order to supply power to these items. Also, the circuit 25 also includes a capacitor 33 connected in parallel with the controller 20. The capacitor 33 reduces the noise in the power supplied to the controller 20 and is connected to the ground 34 along with capacitors 31 and 32.

Referring now to FIG. 2, the controller 20 is formed of a standard programmable integrated chip. Any suitable chip can be used with a preferred chip being the PIC12C671 model chip, manufactured by Microchip Technology, Inc. of Chandler, Ariz. The controller 20 has a number of pins 21*a*–21*h*, shown in FIGS. 2 and 3, which are connected to various other parts of the device 10. For example, when the switch 26 is activated, the power from the batteries 23 is directed to pin 21*g*, as stated previously. Further, in order to give a person using the device 10 a visual indication that the device 10 is operating, power from the second positive voltage source 29*b* passes through a resistor 84 and serves to energize a light emitting diode 86 before passing to pin 21*c* on the controller 20.

The accelerometer 18 is a high performance, high accuracy and complete single-access acceleration measurement system disposed on a single monolithic integrated circuit chip. A preferred accelerometer is the chip having model number ADXL105 manufactured by Analog Devices of Norwood, Mass. The accelerometer 18 is a complete acceleration measurement system on a single monolithic integrated chip. It contains a polysilicon surface-micromachined sensor and BiMOS signal conditioning circuitry to implement an open loop acceleration measurement architecture. The accelerometer 18 is capable of measuring both positive and negative accelerations to a maximum level of ±5 g. The accelerometer 18 also measures static acceleration such as gravity, allowing the accelerometer 18 to be used as a tilt sensor.

The sensor is a surface micromachined polysilicon structure built on top of the silicon wafer. Polysilicon springs suspend the structure over the surface of the wafer and provide a resistance against acceleration-induced forces.

Deflection of the structure is measured with a differential capacitor structure that consists of two independent fixed plates and a central plate attached to the moving mass. A 180° out-of-phase square wave drives the fixed plates. An acceleration causing the beam to deflect will unbalance the differential capacitor resulting in an output square wave whose amplitude is proportional to acceleration. Phase sensitive demodulation techniques are then used to rectify the signal and determine the direction of the acceleration. An uncommitted amplifier is supplied for setting the output scale factor, filtering and other analog signal processing.

The accelerometer 18 includes a number of pins which receive and output various signals depending on what the pins are connected to. The pins include a self test function pin 36 connected to the controller 20, a pair of power supply pins 38 and 39, a pair of ground pins 41 and 42 connected to the ground 34, an accelerometer output pin 44, a reference voltage pin 46, an amplifier inverting input pin 48, an amplifier noninverting input pin 49 and an amplifier output pin 50.

Operating power is directed to the accelerometer 18 via a connection 37 between the positive voltage connection 29*b* and the pair of power supply pins 38 and 39 on the accelerometer 18. A capacitor 40 is located on the connection 37 in series with the power supply pins 38 and 39 in order to buffer and reduce any noise in the power flowing through the connection between the second positive voltage connection 29*b* and the power supply pins 38 and 39.

Upon movement of the infant 12 on which the device 10 is positioned, the accelerometer 18 generates a signal which is transmitted from the accelerator output pin 44 to the amplifier noninverting input pin 49. A reference signal is simultaneously output from the reference voltage pin 46. The reference signal typically has a voltage approximately equal to one-half of the incoming voltage of the power supply ($V_{DD}/2$). The signal from the reference pin 46 contacts a capacitor 51 and a resistor 52 prior to reaching the inverting input pin 48 and sets the internal amplifier to mid scale. The capacitor 51 and resistor 52 are connected in series with one another to form a high pass filter 54 for the amplifier inverting input signal. High pass filter 54 allows any signals over 0.09 Hz to pass through the filter to the amplifier inverting pin 48. The high pass filter 54 can alternatively be configured to provide any required upper limit for the accelerometer output signal by changing the properties of the capacitor 51 and resistor 52.

The signals reaching the amplifier noninverting input pin 49 and amplifier inverting input pin 48 are then directed to an internal amplifier (not shown) formed within the accelerometer 18. The amplifier utilizes the noninverting input signal and inverting input signal coming from the respective pins 49 and 48, to create an amplifier output signal. The output signal is conducted out of the accelerometer 18 through the amplifier output pin 50. The signal is directed from the output pin 50 back to a motion pin 21*a* on the controller 20. Before reaching the motion pin 21*a*, a portion of the output signal is directed and passes through a resistor 60 that is operably connected to the output of the reference voltage pin 46 after the reference voltage signal passes through the high pass filter 54. The combination of the signals from the resistor 60 and from the high pass filter 54 results in a gain to the overall signal supplied to the amplifier inverting pin 48. Furthermore, the portion of the output signal not passing through the resistor 60 passes a resistor 62 and capacitor 64 connected to the ground 34 that cooperate to function as a low pass filter 66 for the output signal, allowing the portion of the output signal below sixteen (16) Hz to pass through to the motion pin 21*a* on the controller 20. The low pass filter 66 can alternatively be configured to provide any required lower limit for the accelerometer output signal by changing the respective properties of the capacitor 64 and resistor 62.

Once the output signal reaches the motion pin 21*a*, the output signal is analyzed by the controller 20 in order to determine whether the output signal indicates movement by the infant 12 on which the device 10 has been positioned. If the output signal is determined to be representative of spontaneous motion by the infant 12, the controller 20 resets an internal timer (not shown) located within the controller 20. The timer continuously and repeatedly counts down a specified period of time in which the controller 20 must receive an output signal from the accelerometer 18. The amount of time that the timer counts down after receiving an output signal from the accelerometer 18 can be varied as necessary, but is set based on the construction of the controller 20 to preferably be within a range typically utilized for devices of this type. Representatively, the countdown time may be fifteen (15) seconds.

However, if the output signal from the accelerometer 18 does not indicate movement by the infant 12, or if the controller 20 does not receive an output signal in the amount of time specified by the timer, the controller 20 sends an output signal through a buzzer pin 21*c*. The signal from the pin 21*c* of the controller 20 activates an alarm circuit 69. The alarm circuit 69 includes a resistor 70 connected to a transistor 72 having the emitter connected to the ground 34. The collector of the transistor 72 is operably connected to an audible signal generator such as an alarm or buzzer 74. The buzzer 74 is disposed within a circuit 75 that is connected to the first positive voltage source 29*a* and to the ground 34. When the alarm circuit 69 is not activated by the controller 20, power from the first source 29*a* flows through a flow-restricting or flyback diode 76 to the alarm 74. The power does not activate the alarm 74, due to the state of the transistor 72 which is connected to the ground 34, but continues through the circuit 75 to a second flyback diode 76. Due to the placement of the diodes 76, the power can be directed to a capacitor 78 connected to the ground 34. This configuration for the circuit 75 allows the power from source 29*a* to recirculate through the circuit 75 when power from the controller 20 to the alarm 74 is turned off, making the alarm 74 more efficient.

Once the controller 20 sends an output signal to activate the alarm circuit 69, the output signal activates the transistor 72, opening a path for the power from the first source 29*a* directly through the alarm 74 to the ground 34 through the transistor 72. As a result, the power activates the alarm 74 to generate sound. More specifically, the alarm 74 is switched on and off at a high rate by the signal from the controller 20 in order to generate whatever sound frequency is desired. Typically, the frequency is between two (2) to three (3) kilohertz (KHz).

As the alarm 74 is generating the sounds to stimulate movement by the infant 12 or to alert another individual, if the controller 20 receives signals from the accelerometer 18 indicating a continued lack of movement or continues to not receive output signals from the accelerometer 18, the controller 20 will continue to activate the alarm 74. However, if the controller 20 subsequently receives signals from the accelerometer 18 indicating movement by the infant 12, the controller 20 will cause the alarm 74 to stop by discontinuing the signal being sent from the controller 20 to the transistor 72 to deactivate the transistor 72.

The signal outputted by the controller 20 through the buzzer pin 21*c* can vary in intensity or duration depending upon the type of output signal received from the accelerometer 18. The controller 20 can be programmed to distinguish between output signals from the accelerometer 18 that represent different types of motions of the infant, such as when the infant is asleep, when the infant is awake and moving, when the infant rolls over, or when the infant falls. Therefore, based upon the particular form of the signal generated by the controller 20 to activate the transistor 72 and trigger the alarm 74 in response to the output signal received from the accelerometer 18 or lack thereof, the sound generated by the alarm 74 will correspond to the form of the controller output signal. For example, if the output signal from the accelerometer 18 indicates no movement by the infant 12, the signal from the controller 20 can activate the transistor 72 to cause the alarm 74 to emit a constant tone sound. Alternatively, if the signal from the accelerometer 18 indicates a condition other than non-movement of the infant 12, the controller 20 can send a signal to the transistor 72 to cause the alarm 74 to produce a sound indicative of the specific condition which is different from the sound generated by a lack of movement of the infant 12, i.e. an intermittent sound, a pair of different pitch sounds, etc.

The device 10 also includes components that allow the manufacturer of the device to determine whether the device 10 is functioning correctly prior to shipping the device. By applying voltages to a number of test points 83A–83K connected to the signal paths at various points in the device 10 and analyzing these voltage signals as they pass through the device 10, i.e., to and from the accelerometer 18, the controller 20, the power source 22, and/or the alarm mechanism 24, the controller 20 can analyze whether the accelerometer 18, controller 20 or alarm mechanism 24 is functioning incorrectly, or whether a connection between two of the components is defective. If one or more of the test points 83A–83K indicates that the device 10 is not functioning correctly at that point, the device 10 can either be repaired or discarded as desired.

While the invention is illustrated in the drawings and the accompanying description in connection with a specific embodiment, it is understood that this embodiment is only representative of one construction of the invention and that numerous variations and alternatives are contemplated as being within the scope of the invention. For example, and without limitation, the form of the circuitry and type of controller 20 connected to the accelerometer 18 can be varied in any number of different ways to accomplish the desired result of the invention. Further, while the alarm 74 preferably emits an audible signal, alternatively, the alarm 74 could be a light or vibration source used alone or in connection with an audible alarm capable of waking and/or stimulating the infant 12.

Various alternatives and embodiments are contemplated as being within the scope of the following claims particularly pointing out and distinctly claiming the subject matter regarded as the invention.

I claim:

1. An apparatus for sensing the lack of motion of an infant, the apparatus comprising:

a) an accelerometer formed as a monolithic integrated circuit chip adapted to sense a lack of movement of the infant and to generate an accelerometer output signal in response to the lack of movement containing an output signal component within a specific signal range;

b) a controller connected to the accelerometer and used to analyze the accelerometer output signal; and c) a sensory perceptible signal generator connected to the controller and selectively activatable by the controller in response to the accelerometer output signal wherein the accelerometer, the controller and the sensory perceptible signal generator are contained within a housing.

2. The apparatus of claim 1 wherein the sensory perceptible signal generator is an audible alarm.

3. The apparatus of claim 1 wherein the sensory perceptible signal generator is a light source.

4. The apparatus of claim 1 wherein the housing is made of a rigid material.

5. The apparatus of claim 1 wherein the housing includes a means for securing the housing to the infant.

6. The apparatus of claim 1 wherein the accelerometer output signal is a frequency signal.

7. The apparatus of claim 6 further comprising a high pass filter disposed between the accelerometer and the controller to remove a portion of the accelerometer output signal having a frequency above the output signal component.

8. The apparatus of claim 6 further comprising a low pass filter disposed between the accelerometer and the controller to remove a portion of the accelerometer output signal having a frequency below the output signal component.

9. The apparatus of claim 1 wherein the controller is formed as a programmable integrated circuit chip.

10. The apparatus of claim 1 further comprising a power source connected to the controller.

11. The apparatus of claim 10 wherein the power source includes at least one battery.

12. The apparatus of claim 11 wherein the power source is disposed within a housing containing the accelerometer, the controller, and the sensory perceptible signal generator.

13. The apparatus of claim 10 wherein the power source is connected to the controller by a selectively operable switch.

14. The apparatus of claim 1 wherein the controller includes an analog to digital signal converter.

15. The apparatus of claim 14 wherein the accelerometer output signal is an analog signal.

16. The apparatus of claim 15 wherein the accelerometer is connected to the analog to digital converter.

17. A method of sensing a lack of motion of an infant, the method comprising the steps of:

a) providing a device for sensing a lack of motion, including a housing, an accelerometer formed of a monolithic integrated circuit chip and disposed within the housing and adapted to create an accelerometer output signal in response to a lack of movement of the infant, a controller disposed within the housing and connected to the accelerometer and adapted to receive the accelerometer output signal, and a sensory perceptible signal generator disposed within the housing and operably connected to the controller;

b) activating the device;

c) attaching the device to the infant;

d) detecting a lack of movement of the infant to create the accelerometer output signal, and e) activating the sensory perceptible signal generator in response to the accelerometer output signal to encourage spontaneous movement by the infant if no movement is detected.

18. The method according to claim 17 wherein the device further comprises a securing means disposed on the housing and the step of attaching the device to the infant comprises engaging the securing means to the infant.

19. The method according to claim 17 wherein the device includes a switch and the step of activating the device comprises pressing the switch.

20. The method according to claim 19 wherein the switch is a double pole, double throw switch.

21. The method according to claim 17 wherein the step of detecting a lack of movement of the infant comprises the steps of:

a) generating the accelerometer output signal representative of the lack of movement by the infant;

b) transmitting the accelerometer output signal from the accelerometer to the controller; and c) comparing the accelerometer output signal to a reference value stored in the controller.

22. The method of claim 21 wherein the step of generating the accelerometer output signal further comprises the step of passing the accelerometer output signal through a band pass filter to create an output signal component.

23. The method of claim 22 wherein the filter is a high pass filter.

24. The method of claim 22 wherein the filter is a low pass filter.

25. The method of claim 22 wherein the output signal component is compared to the reference value.

26. The method of claim 25 wherein the reference value corresponds to a level of no movement of the infant.

27. The method of claim 17 wherein the accelerometer output signal varies in response to the movement of the infant.

28. The method of claim 27 wherein the level of activation of the sensory perceptible signal generator varies in response to variations in the accelerometer output signal.

29. A device for sensing a lack of movement of an infant, comprising:

a housing adapted to be secured to the infant;

an accelerometer contained within the housing for detecting the lack of movement of the infant; and a sensory output device contained within the housing and interconnected with the accelerometer for providing a sensory output in response to detection by the accelerometer of a lack of movement by the infant.

* * * * *